US005160088A

United States Patent [19]

Weiss et al.

[11] Patent Number: 5,160,088

[45] Date of Patent: Nov. 3, 1992

[54] INJECTION PUMP FOR DIESEL ENGINES

[75] Inventors: Gerhard Weiss, Marchtrenk; Peter Baumgartner, St. Andrae, both of Austria

[73] Assignee: VOEST-ALPINE Automotive Gesellschaft m.b.H., Linz, Austria

[21] Appl. No.: 613,659

[22] PCT Filed: Jan. 30, 1990

[86] PCT No.: PCT/AT90/00014

§ 371 Date: Nov. 26, 1990

§ 102(e) Date: Nov. 26, 1990

[87] PCT Pub. No.: WO90/08892

PCT Pub. Date: Aug. 9, 1990

[30] Foreign Application Priority Data

Jan. 30, 1989 [DE] Fed. Rep. of Germany ..... 3902670

[51] Int. Cl.[5] ..... F02M 59/20

[52] U.S. Cl. ..... 239/88; 123/503

[58] Field of Search ..... 239/88-92, 239/533.1-533.9; 123/503

[56] References Cited

U.S. PATENT DOCUMENTS 4,571,161 2/1986 Leblanc et al. ..... 239/88

4,846,114 7/1989 List ..... 239/88

FOREIGN PATENT DOCUMENTS 0263304 4/1988 European Pat. Off. .

940384 3/1956 Fed. Rep. of Germany .

3612709 10/1986 Fed. Rep. of Germany .

319362 3/1957 Switzerland .

*Primary Examiner*—Andres Kashnikow

*Assistant Examiner*—Lesley D. Morris

*Attorney, Agent, or Firm*—Cushman, Darby & Cushman

[57] ABSTRACT

In a fuel injection pump for diesel engines, in which at least one pump piston (5) forms a high pressure chamber (6) with a pump piston bushing (1) and is surrounded by a control sleeve (3), whereby the angle position between pump piston (5) and control sleeve (3) is variable to adjust the quantity, and whereby an axial bore hole (11) in the pump piston (5) connects the high pressure chamber (6) with a control bore hole (12) or with a groove forming a shutoff edge and a startup edge to end the injection process, which works together with a control edge (15,17) or control bore hole of the control sleeve (3), an intake and/or supply bore hole (7), separate from a discharge bore hole (9), is provided. In this way, the pump piston (5) or the control sleeve (3) has, in addition to the control bore hole (12) present, an auxiliary control bore hole (13) that is completely covered by the startup edge (15) assigned to it, sooner than or simultaneously with the control bore hole (12) and which is not released by the shutoff edge (17) before the control bore hole (12) and the control bore holes (12,13) can be connected with the discharge bore hole (9).

11 Claims, 8 Drawing Sheets

INJECTION PUMP FOR DIESEL ENGINES

Figure 1:
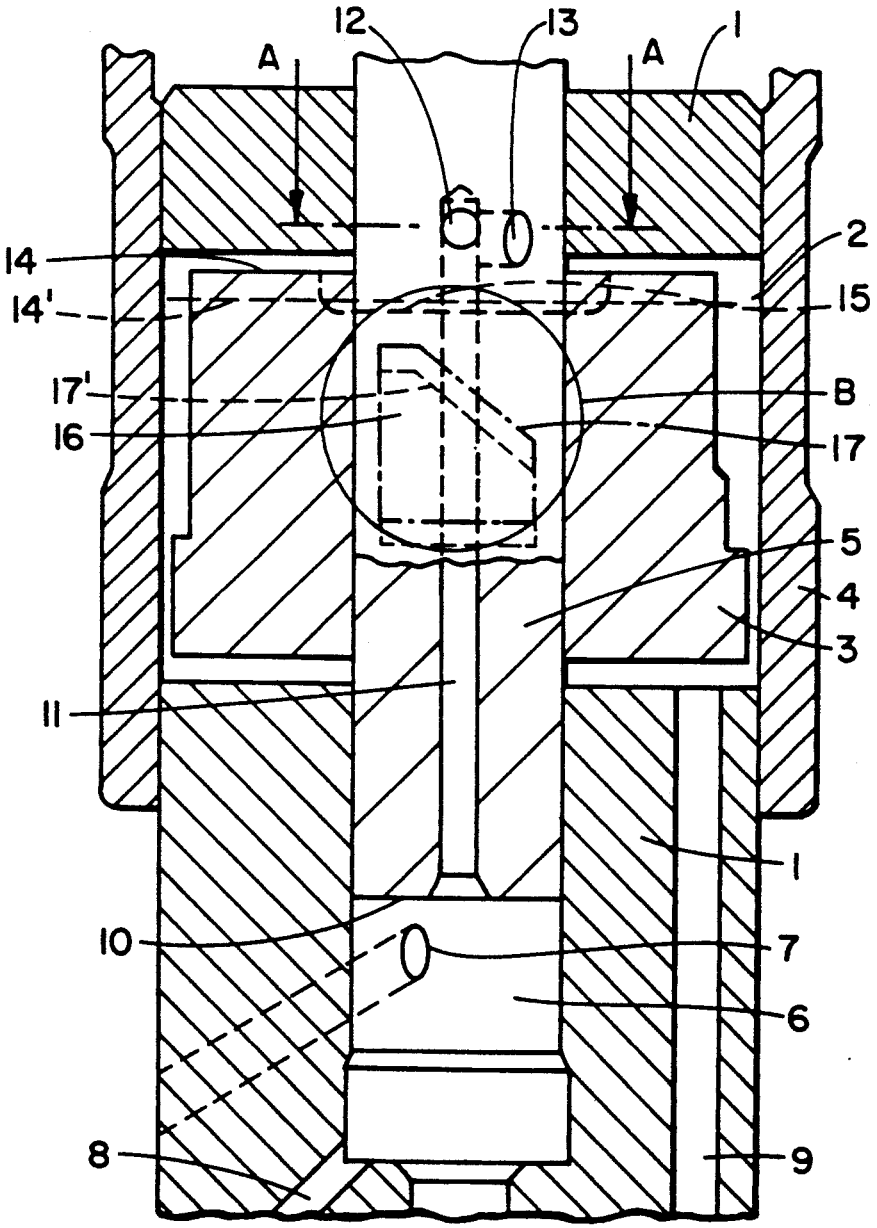

The invention relates to a fuel injection pump for diesel engines, in which at least one pump piston with a pump piston bushing creates a high pressure chamber and is surrounded by a control sleeve, whereby the angle position between pump piston and control sleeve is variable to adjust the quantity and whereby an axial bore hole in the pump piston connects the high pressure chamber with a control bore hole or a groove forming a shutoff edge and a startup edge to end the injection process, which works together with a control edge or control hole in the control sleeve.

In DE-OS 35 90 194, various versions of a series pump are described, whereby in one embodiment a radial bore hole in the piston works together with a startup edge and a shutoff edge of the control sleeve and in another embodiment a groove on the piston supplied by a radial bore hole works together with a control bore hole in the control sleeve.

In DE-OS 36 30 647, a pump nozzle is described in whose injection pump a groove on the piston fed by a radial bore hole works together with a control bore hole in the control sleeve. In other pump nozzles (e.g DE-OS 31 43 073) a radial bore hole of the pump piston works together with control edges of the control sleeve. In all of them, the control sleeve can also be moved axially to adjust the start of injection.

All these injection pumps, with an axial bore hole in the piston that leads from the high pressure to the control openings, are of the SIMMS construction type, which distinguishes itself with a symmetrical and thus light and easy to manufacture piston. However, at very high injection pressures and high pump piston speed, in current diesel engines with speeds up to 5000 rpm and high pressure injection, this construction type has disadvantages.

Starting at a certain engine speed and with late injection start, a quantity of fuel leaks out of the injector nozzle before the start of the injection and/or the pilot injection in nozzles with divided injection, the so-called pre-supply. This is undesirable, since its disrupts that exact control of the injection start, disrupts the form of the injection curve by an extended injection duration and interruption of the pressure increase and decreases the injection adjusting range.

This disadvantageous pre-supply is caused by the fact that starting at the pump piston position in which the feed holes are already closed, the axial and the connecting radial bore holes in the piston and/or in the control sleeve still have fuel flowing through them until the radial bore holes are completely closed. At certain pump piston speeds, this causes a pressure wave passing through the axial bore hole which is deflected into the high pressure chamber if the cross section of the radial bore holes is too small. These pressure peaks can exceed the opening pressure of the injection nozzle, whereby a little fuel passes into the engine combustion chamber.

A further cause of the pre-supply is the throttle effect of the various bore holes. With successive covering of the control bore hole, as well as with fast cross section decrease, the pressure in the high pressure chamber increases so strongly according to the throttle curve that the opening pressure of the valve needle is achieved prematurely.

Modern vehicle diesel engines have a deceleration fuel shut off that shuts off the fuel supply completely during braking and when driving over downhill stretches. In this zero-feed, as it is called, in the known injection pumps, there are sudden injections at higher engine speeds because of similar dynamic effects. This represents a heavy safety risk and also increases fuel consumption. In fact, during zero feed, the flow path between SIMMS bore hole and control sleeve chamber may never be completely closed. The free cross section must even remain so large that in spite of dynamic effects and throttle curve the opening pressure of the valve needle is not achieved.

Finally, a fine adjustment of the idle injection pump that is as exact as possible is desireable above all in modern diesel engines with single cylinder control, in order to assure smooth idling. That is only partially possible with known injection pumps because the increase of the shutoff edge produces the relationship between rotational angle and change in injection quantity, whereby this increase is too steep for idle control.

Finally, a throttle effect is also noticeable as damping during shutoff. Although a damped shutoff is generally desireable at the end of the injection, this is undesirable during the maximum injection quantity, and because of this the injection process lasts somewhat long, which leads to incomplete combustion.

Tests to prevent pre-supply and similar dynamic events by design measures, for example an expansion of the axial SIMMS bore hole, which however decreases the effective stroke, or larger discharge cross sections from the control sleeve chamber, have had little success up to now.

Thus the goal of the invention is to limit or completely prevent the described dynamic effects in injection pumps of this type.

To solve this task, it has been suggested that an intake and/or feed hole that is separate from a discharge hole is provided, that the pump piston or the control sleeve has an auxiliary control bore hole in addition to the present control bore hole, which can be completely covered by the startup edge assigned to it earlier than or simultaneously to the control bore hole and that is not released by the shutoff edge before the control bore hole and that the control bore holes can be connected to the discharge bore hole.

The auxiliary control bore hole decreases the throttle effect that leads to a deflection of the pressure wave and decreases the speed of the control cross section decrease during shutoff. In this way, pre-supply only occurs at a much greater engine speed, which usually lies over the nominal engine speed. In this way, the speed of the cross section decrease is still lower, since the auxiliary control bore hole is completely covered even somewhat earlier than the control bore hole. Because of the decreased throttle effect, suddenly occurring injections are omitted during zero feed and higher rpm. Because of the fact that the auxiliary control bore hole is not opened before the control bore hole during shutoff, the control times remain unchanged and the effective stroke is completely maintained. Thus, the ending of the injection process thus occurs because of the opening of the control bore hole, whereby because of an additional opening of the auxiliary control bore hole that occurs subsequently or at the earliest simultaneously, a faster pressure drop and improved closing characteristic can be achieved.

According to a preferred embodiment of the invention, the auxiliary bore hole is mounted in a position relative to the control bore hole which corresponds to a larger injection quantity and the auxiliary control bore hole and the control bore hole are completely covered by a mutual startup edge simultaneously or the auxiliary control bore hole somewhat earlier than the control bore hole. This means that the sliding over of both control bore holes is simultaneously or almost simultaneously ended by the startup edge. This leads to low construction costs and particularly simple manufacture, because only one control edge is required that needs to be machined precisely.

In an especially advantageous version, the diameter of the auxiliary control bore hole is larger than that of the control bore hole. This is possible without changing the control times since the shutoff edge lies at an angle and the auxiliary control bore hole on the position of the control bore hole corresponding to a larger injection quantity. Because of this, the throttle effect is further decreased and the dynamic effects, like pre-supply or an injection during zero-feed are more securely prevented. In addition, it is possible in this way to adjust the idle more closely since, because of the presence of two bore holes of different diameters at basically the same height with a relatively large rotational angle of control sleeve or pump piston, only a very slight variation in quantity can be achieved.

In a further improvement, the shutoff edge can be designed so that its slope decreases or becomes zero or negative at the end corresponding to maximum injection quantity. Because of this, in this extreme state, both control bore holes are released by the shutoff edge, whereby the injection pressure decreases more quickly and the injection duration becomes somewhat shorter, whereby incomplete combustion is prevented.

In one variation, the control bore holes are arranged in the pump piston and the control edges are arranged in the control sleeve in a way that is advantageous from the point of view of production technology. In another variation, the grooves in the pump piston forming the control edges and the control bore holes are arranged in the control sleeve and both grooves are connected to the SIMMS axial bore hole in the pump piston, each via a radial bore hole of its own.

This variation generally has the advantage that the control sleeve has no control edges, but only control bore holes and thus is more stable in form. Because of the separated radial bore holes at different heights in the pump piston, the throttle length of the axial bore holes is lower and the possibility is gained of additionally influencing the throttle effect, particularly with respect to minimum throttling during startup.

In an additional, modified embodiment, the auxiliary control bore hole in the direction of the pump axis is arranged above or below the control bore hole in the piston or in the control sleeve and the control sleeve or the pump piston has two startup edges at the same distance from each other as the distance between control bore hole and auxiliary bore hole. In comparison to the first version, this version has the additional advantage that the radial bore holes (control bore holes and/or supply lines to the grooves) leading away from the axial SIMMS bore hole in the piston lie at different heights and in this way, the piston cross section is decreased less and the pressure waves in the SIMMS bore hole arrive at the control openings at different times. In addition, the throttle length also decreases. In a variation that is favorable to production technology, the control bore holes are mounted in the pump piston and the control edges in the control sleeve. If in one variation control bore hole and auxiliary control bore hole are mounted in the control sleeve and the control edges in the piston, the control sleeve is weakened less structurally.

Preferably, a second shutoff edge is mounted in such a way that it is reached by the auxiliary bore hole only at maximum injection quantity, whereby also in this embodiment a shortened injection time can be achieved at full load.

Finally, it is advantageous in all embodiments and their variations to arrange all control bore holes and control edges doubled, turned 180°.

Figure 3:
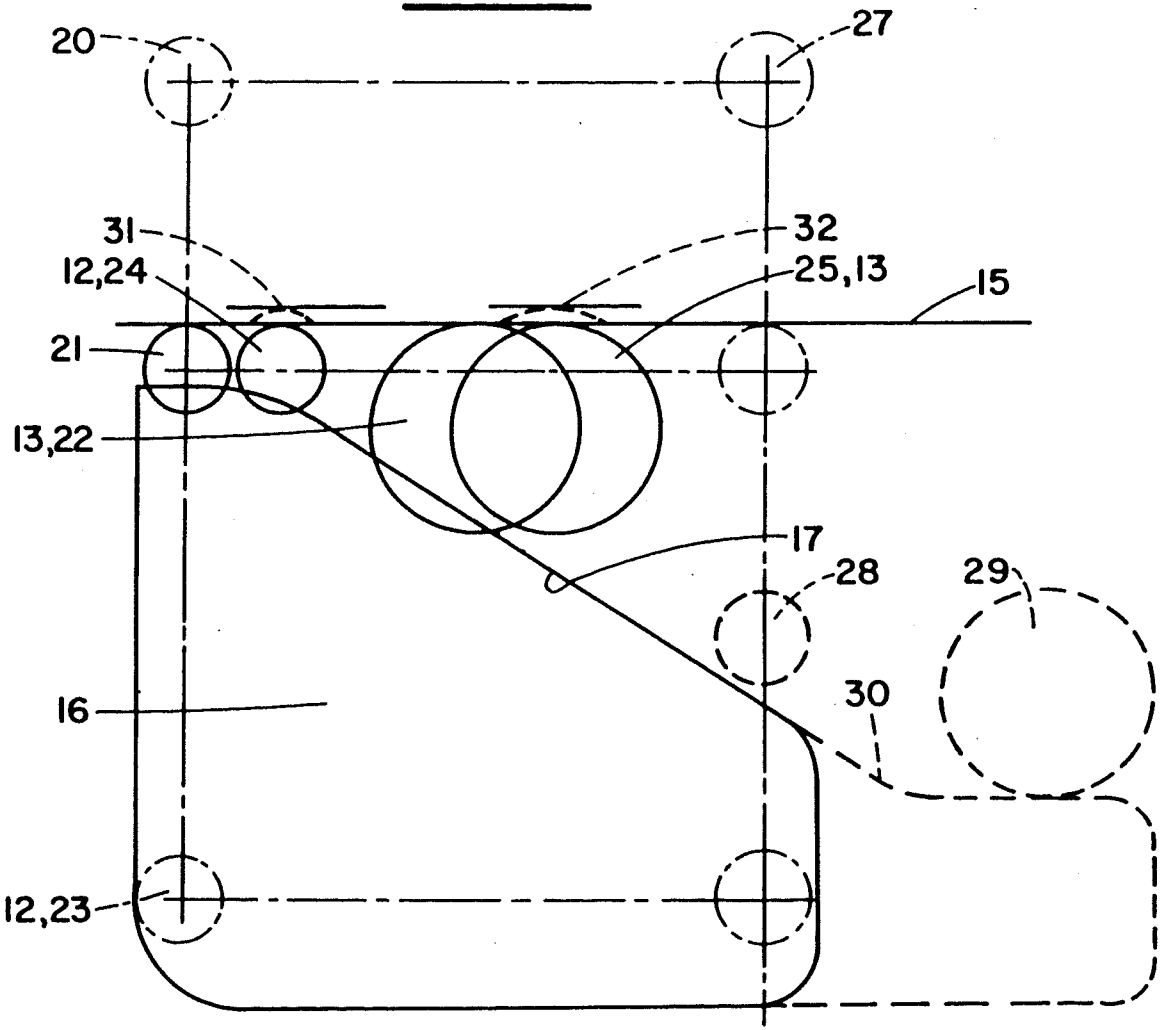
Figure 2:
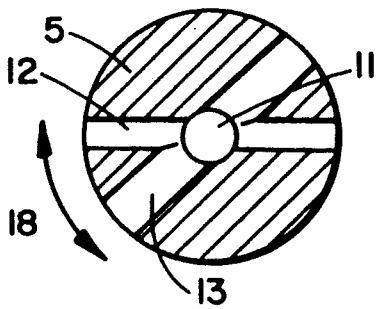
Figure 4:
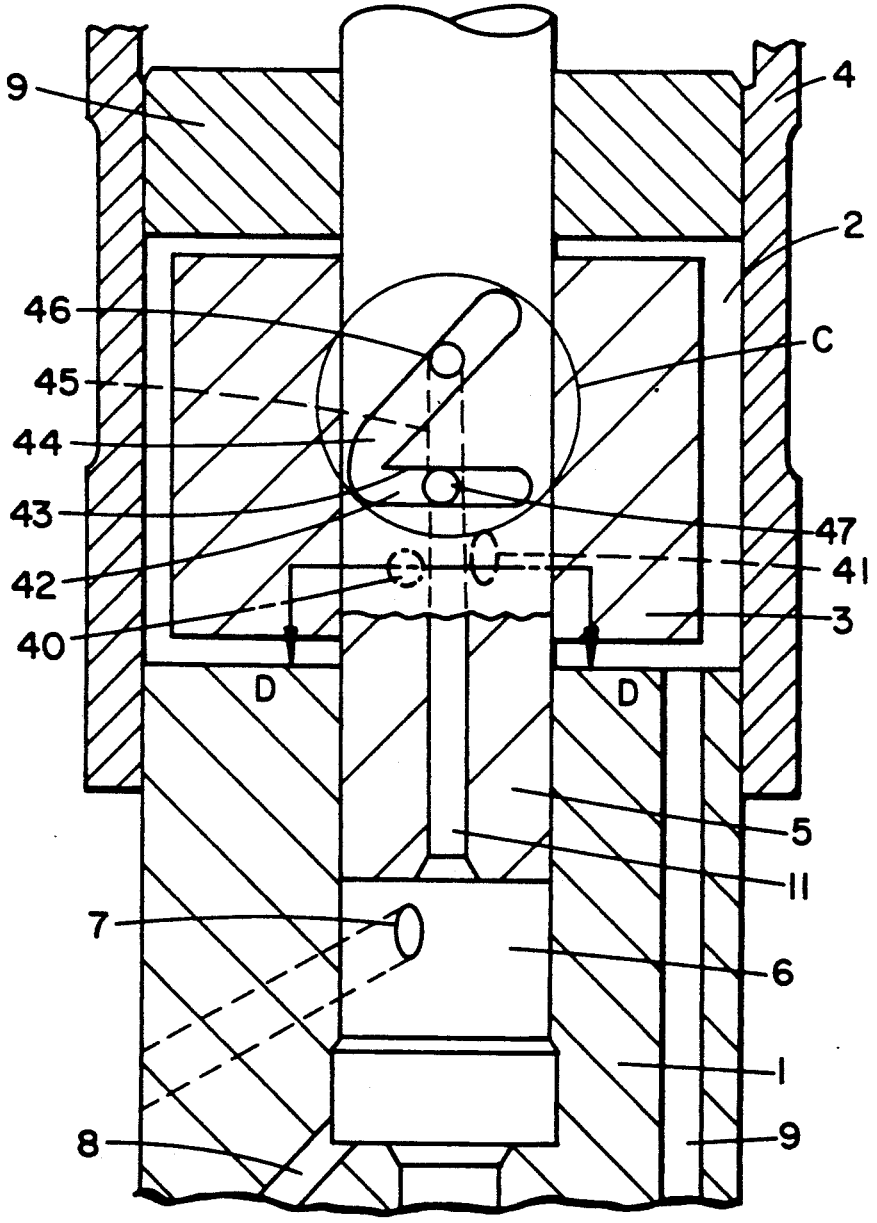
Figure 5:
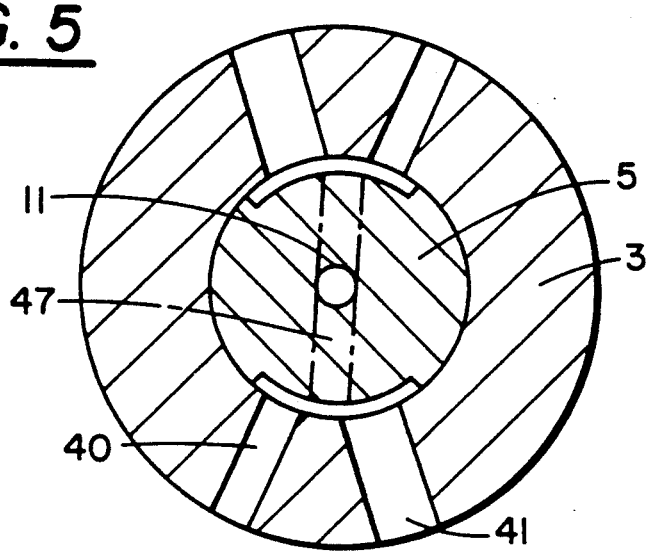
Figure 6:
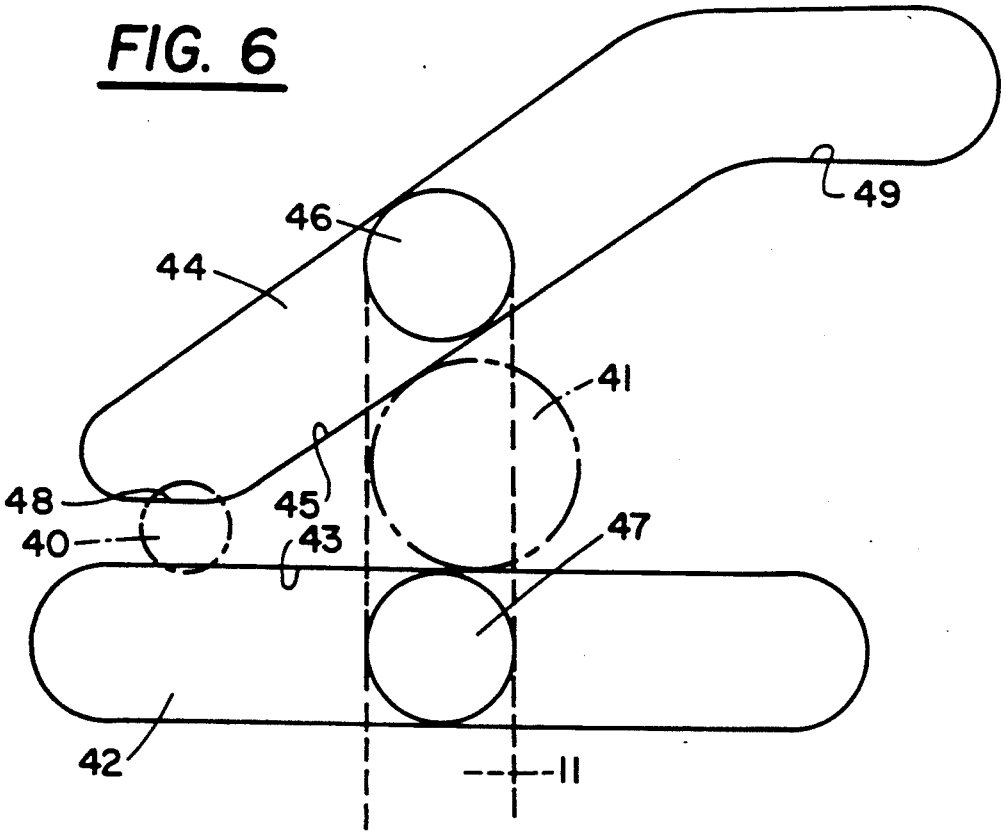
Figure 7:
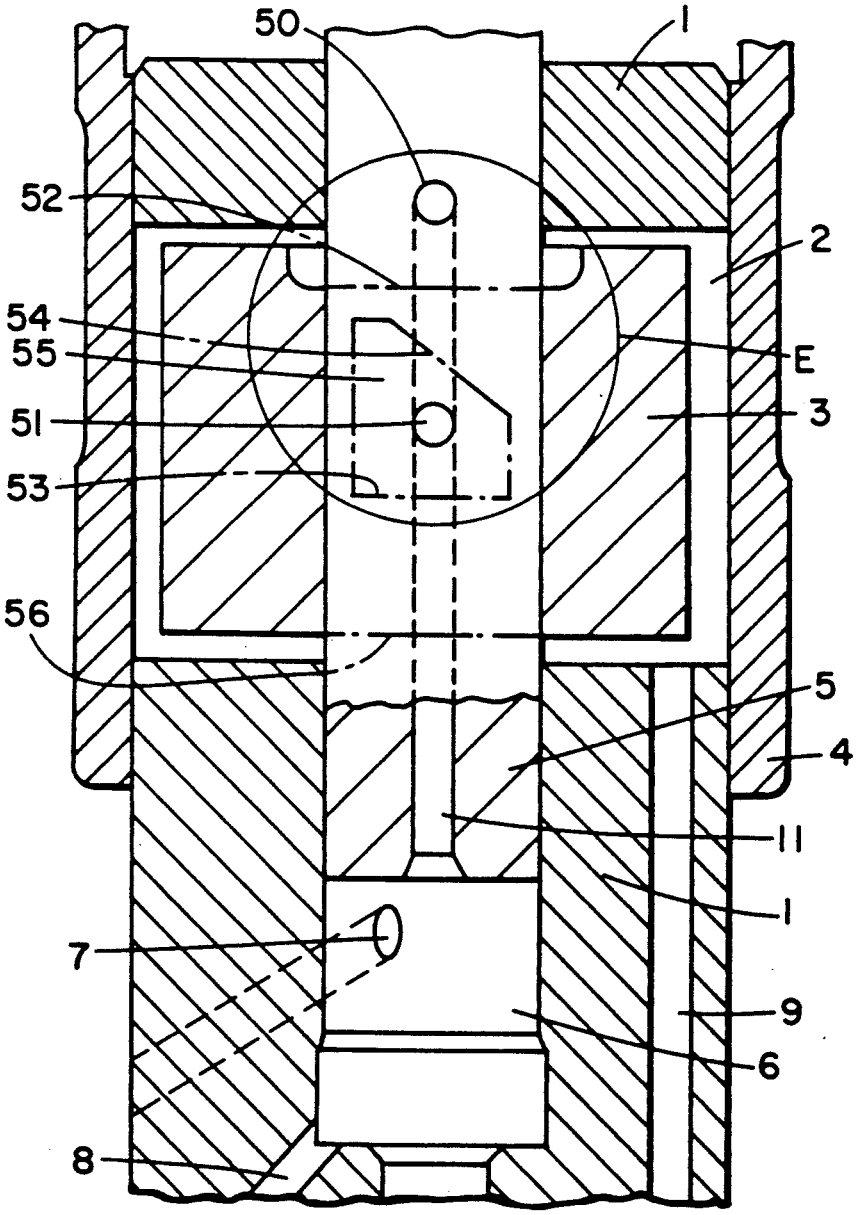
Figure 8:
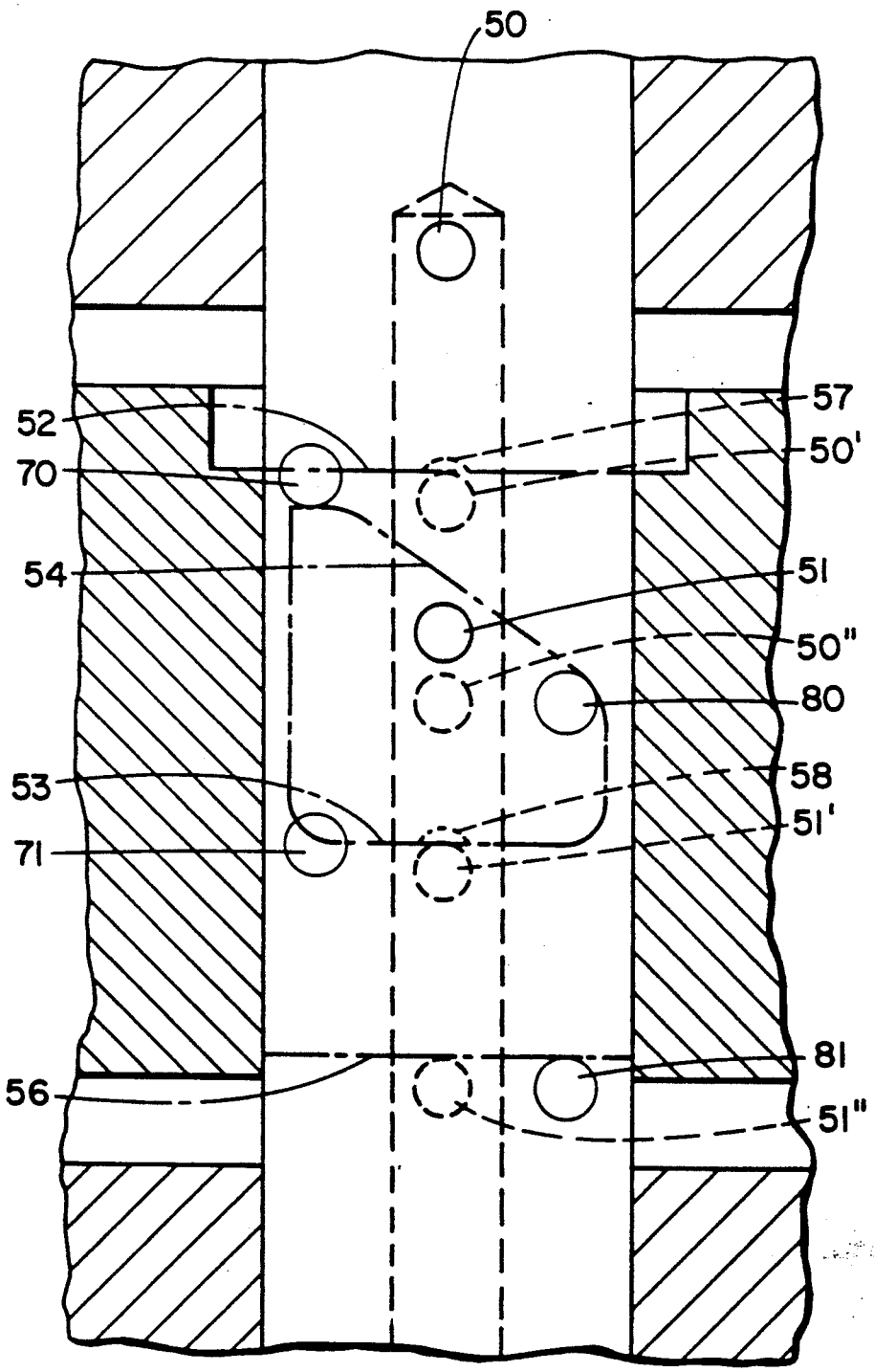
Figure 9:
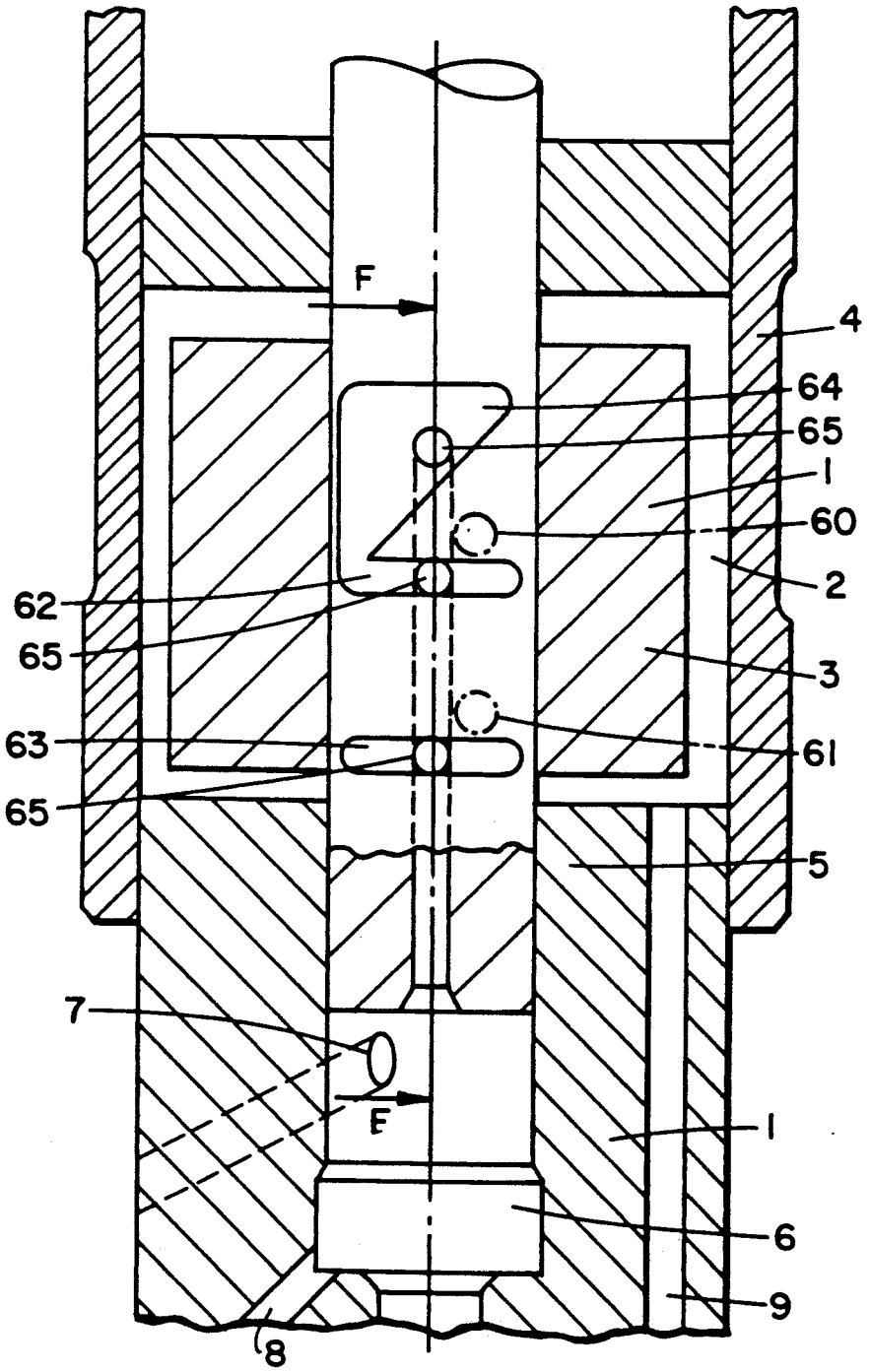
Figure 10:
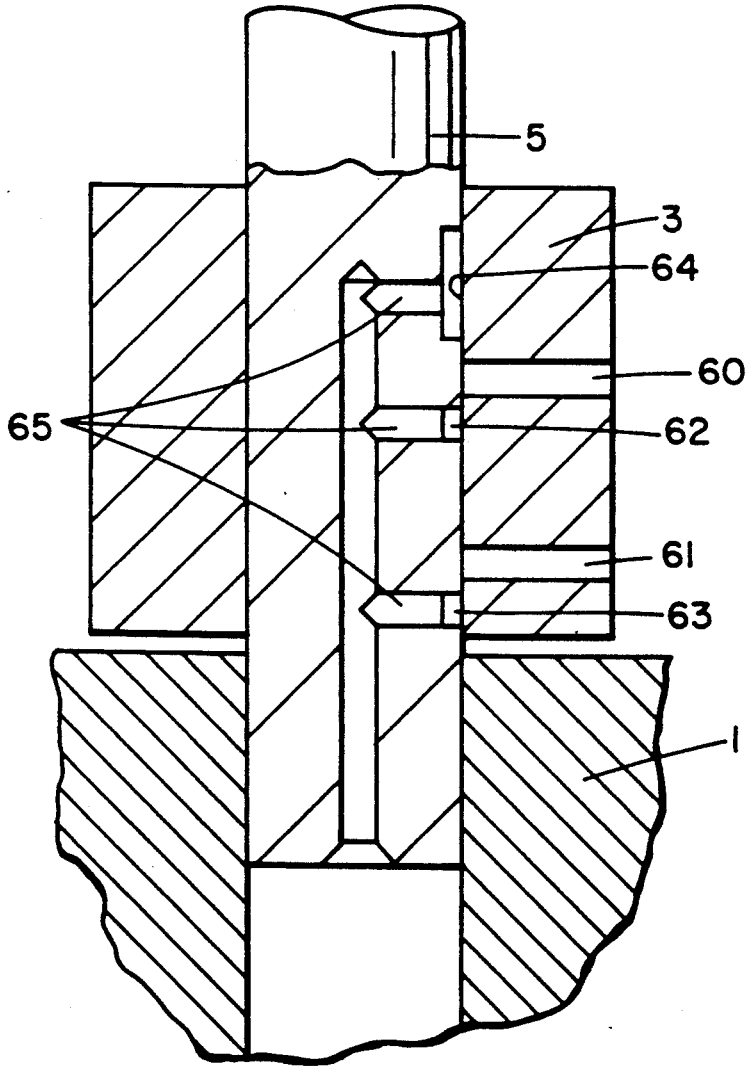

In the following, various embodiments of the invention and their variations are described using illustrations. They show:

FIG. 1 a lengthwise cross section through an injector nozzle according to the invention in a first embodiment, FIG. 2 a cross section along line AA in FIG. 1 in enlarged representation, FIG. 3 Detail B of FIG. 1, projected and enlarged, FIG. 4 a variation of the first embodiment in lengthwise cross section, FIG. 5 a cross section along line DD in FIG. 4 in enlarged representation, FIG. 6 Detail C of FIG. 4, projected and enlarged, FIG. 7 a second embodiment of the injection pump according to the invention in longitudinal cross section, FIG. 8 Detail E in FIG. 8, projected and enlarged, FIG. 9 a variation of the second embodiment and FIG. 10 a cross section along line FF in FIG. 9.

The important parts of an injection pump of the types to which the invention refers have the same reference numbers in all the illustrations. 1 indicates a pump piston bushing with a recess 2, 3 a control sleeve installed in this recess, which for example is turned to set the quantity and raised and lowered to adjust the spray, 4 a separating sleeve surrounding the pump piston bushing 1, 5 a pump piston driven by a camshaft not shown, 6 a high pressure chamber, 7 a schematically indicated inlet bore hole and/or supply bore hole, 8 a high pressure bore hole that is connected to a nozzle plunger chamber not shown and 9 a discharge bore hole for the fuel that accumulated during shutoff. Startup is understood to mean the closing of the control openings, whereby the pressure increases in high pressure chamber 6 and as a consequence the injection starts; shutoff is understood to mean the opening of the control openings, whereby the injection is ended.

In a first embodiment of the invention, the pump piston 5 has an axial bore hole 11 coming out of its front side 10, which is in connection with a radial control bore hole 12 and a likewise radial auxiliary bore hole 13. The control sleeve 3 has an upper control edge 15, which surrounds it horizontally and forms the startup edge, and an inclined shutoff edge 17 that forms a window 16. The control sleeve 3 is indicated in one position 14 which corresponds to an early injection start. The position 14', 17' indicated with dotted lines corresponds to a late injection start. By turning the control sleeve 3 or the pump piston 5, various parts of the control edge 17 meet the control bore holes 12, 13, as will be explained in more detail below.

In FIG. 2, it can be seen that the control bore hole 12 and the auxiliary control bore hole 13 form an angle to each other and that the bore holes are designed as passthrough bore holes. This corresponds to a doubling of the control elements, even if the control sleeve 3 contains two windows 16 turned at 180° to each other.

FIG. 3 shows a schematic projection of the respective arrangement of the control elements. The control sleeve 3 is only indicated by the startup edge 15 and the shutoff edge 17 forming window 16. In the illustration, a rotation of the control sleeve corresponds to a displacement to the left or the right. The pump piston 5 is only indicated in different positions by the control bore hole 12 and the auxiliary control bore hole 13.

The position 20 of the control bore hole 12 corresponds to the top dead center of pump piston 5 during zero feed, the position 23 corresponds to bottom dead center. In position 21, the control bore hole just slides over the startup edge 15 and the shutoff edge 17. Because of their small separation, however, it is never completely covered, so no feed occurs (zero feed). The auxiliary control bore hole 13 takes the position 22 at this time. Since this is also never completely covered, its cross section that remains free contributes to the fact that even at high speed no feed occurs because of dynamic effects.

During idle, that is at very low injection quantity, the control bore hole 12 is located in position 24 and the auxiliary bore hole 13 is located in the assigned position 25. It can be seen that the idle speed can be very finely adjusted because of the slight slope of the shutoff curve part 26 at this point. However, above all, the main effect of the invention by which pre-supply is prevented can be recognized in positions 31, 32 of the control bore hole and the auxiliary bore hole 13 shortly before it, indicated by dotted lines. What is important for this effect is the fact that the open cross section is still very large shortly before the shutoff because of the presence of two bore holes, in other words, because of the fact that the control bore hole 12 and the auxiliary bore hole 13 lie in such a way that they are completely covered simultaneously or almost simultaneously, i.e. that in this moment, the startup edge 15 contacts both control bore holes and/or the auxiliary control bore hole slightly earlier. The diameter of the auxiliary bore hole 13 is selected in such a way that it is not released by the shutoff edge 17 before the control bore 12. The auxiliary bore hole 13 thus lies "in the shadow" of control bore hole 12, with respect to shutoff edge 17. In this way, it is not affected during the shutoff and thus the entire operating range is maintained.

In certain engines there is the problem that the injection lasts too long at maximum injection quantity. A correction is possible, in that the shutoff edge 17 is elongated by the piece 30 indicated with a dotted line, which is horizontal here, but can have a low or even negative slope. In this way, shutoff occurs at maximum injection quantity via the control bore hole and the auxiliary bore hole, whereby it runs more quickly and the injection length becomes somewhat shorter.

In a variation of the first embodiment, according to FIG. 4, the movement relationships are reversed. Now, the control sleeve 3 has a control bore hole 40 and an auxiliary bore hole 41, but in place of this the pump piston 5 has a startup groove 42 and a shutoff groove 44 on its shroud, which form a startup edge 43 and a shutoff edge 45. The grooves 42, 44 are connected via a radial bore hole 46 and if necessary also via an additional radial bore hole 47 with the axial bore hole 11 in the inside of piston 5. FIG. 5 shows the control bore holes 40, 41 in cross section, whereby the piston 5 is located in the position in which the startup groove 42 is at the same height with the control bore holes 40, 41.

FIG. 6 again shows schematically a projection of the piston shroud in a somewhat modified form, in which the grooves 42, 44 are not connected to each other, but in each case via the radial bore holes 46, 47 to the axial bore hole 11. The control bore hole 40 and the auxiliary bore hole 41 are drawn in dotted lines. The shutoff edge 45 goes left into a horizontal part 48 for zero feed and right into a horizontal part 49 for maximum injection quantity. Everything else is analogous to FIG. 3.

In the other embodiment of the invention according to FIG. 7, the auxiliary bore hole 51 is located under the control bore hole 50. In this embodiment, both are in the piston, for example, and open into the axial bore hole 11. The control sleeve 3 has a startup edge 52, an auxiliary startup edge 53, which works together with the auxiliary bore hole 51, and a shutoff edge 54.

The edges 53, 54 form a window 55, which can also be present doubled, turned 180°, when they are also control bore holes 50, 51. Here as well, the auxiliary control bore hole 51 can be larger than the control bore hole 50, with the same effect as in the first embodiment, whereby however the construction height increases somewhat.

In FIG. 8, the respective movement sequence is shown schematically. Positions 50, 51 of the control bore holes correspond at average load to the piston upper dead center, the startup is just ended in positions 50', 51', whereby the dotted line positions 57, 58 occur immediately preceding; here as well the effect occurs that prevents pre-supply. Positions 50'', 51'' correspond to the bottom dead center of piston movement.

Positions 70, 71 occur during zero feed, whereby here as well, the throttle effect is decreased by the appearance of the second bore hole 71. Positions 80, 81 correspond to shutoff at full throttle, whereby here as well accelerated shutoff occurs because of the cooperation of the auxiliary bore hole 81 with the auxiliary control edge 56, which shortens the injection duration.

FIG. 9 and FIG. 10 show a variation of the second embodiment, in which the movement relationships are again reversed. Here the control sleeve 3 has a control bore hole 60 and an auxiliary control bore hole 61 and the pump piston has, on its shroud surface, a startup groove 62, an auxiliary startup groove 63, an expanded startup groove 64 and radial bore holes 65, which connect control grooves 62, 63, 64 to the axial bore hole.

We claim:

1. A fuel injection pump for diesel engines comprising:

at least one pump piston forming a high pressure chamber with a piston bushing, said piston being surrounded by a control sleeve which is rotatably and axially displaceable relative to the piston;

an axial bore provided in said piston, the axial bore communicating with the high pressure chamber;

means for introducing a supply of fluid to said high pressure chamber;

a regular control bore and an auxiliary control bore provided in one of said piston and sleeve, said control and auxiliary control bores being radially oriented relative to the axis of said axial bore;

control edges provided on the other of said piston and sleeve for selectively establishing adjustable fluid flow from the high pressure chamber through said axial and control bores over said control edges to a discharge port from said fuel injection pump in response to axial displacement of the control sleeve relative to the piston, said control bores cooperating with said control edges so that fluid flow through the auxiliary control bore is prevented until fluid flow through the regular control bore is established.

2. A fuel injection pump as claimed in claim 1, wherein the pump piston includes the auxiliary control bore and the regular control bore, and wherein the control sleeve includes the control edges, said control edges including a shutoff edge and a startup edge, said auxiliary control bore being covered by the startup edge such that fluid flow therethrough is prevented until fluid flow through the regular control bore is established, the shutoff edge uncovering said regular control bore before uncovering said auxiliary control bore.

3. A fuel injection pump as claimed in claim 1, wherein said axial bore in the piston connects the high pressure chamber with grooves arranged in the piston and which form the control edges, said control edges including a shutoff edge for ending the injection process and a startup edge which cooperates with a regular control bore of the control sleeve and wherein the control sleeve includes the auxiliary control bore and the regular control bore, said auxiliary control bore being covered by the starting edge such that fluid flow therethrough is prevented until fluid flow through the regular control bore is established, the shutoff edge uncovering said regular control bore before uncovering said auxiliary control bore.

4. A fuel injection pump according to claim 1, 2 or 3, wherein each of the control bores cooperates with the same control edges and wherein flow to the discharge port is increased when fluid flow through the auxiliary control bore is established.

5. A fuel injection pump according to claim 2 or 3, wherein the shutoff edge has a slope which becomes negative when maximum fuel injection occurs.

6. A fuel injection pump according to claim 2 or 3, wherein the auxiliary control bore is spaced from the regular control bore in the direction of the axis of the piston, and wherein two startup edges are provided which cooperate with the control bores, the distance between the startup edges being equal to the distance between the auxiliary control bore and the regular control bore.

7. A fuel injection pump according to claim 1, 2 or 3, wherein the auxiliary bore is larger than the regular control bore.

8. A fuel injection pump according to claim 2 or 3, wherein the shutoff edge has a slope which decreases when maximum fuel injection occurs.

9. A fuel injection pump according to claim 3, wherein the grooves forming the shutoff edge and startup edge each are connected to the axial bore in the pump piston via its own radial bore.

10. A fuel injection pump according to claim 2, wherein a second shutoff edge is provided that is cooperable with the auxiliary bore only at maximum injection quantity.

11. A fuel injection pump according to claim 2 or 3, wherein duplicate control bores and control edges are provided at respective locations angularly displaced 180° from the locations of said first mentioned control bores and control edges.

* * * * *